US011828491B1

(12) United States Patent
Wells et al.

(10) Patent No.: US 11,828,491 B1
(45) Date of Patent: Nov. 28, 2023

(54) WATER HEATER APPLIANCES AND METHODS FOR MITIGATING FALSE FAULT DETECTION

(71) Applicant: Haier US Appliance Solutions, Inc., Wilmington, DE (US)

(72) Inventors: Jacob Wells, Louisville, KY (US); Paul Goodjohn, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/867,784

(22) Filed: Jul. 19, 2022

(51) Int. Cl.
*F24H 15/175* (2022.01)

(52) U.S. Cl.
CPC ..... *F24H 15/175* (2022.01)

(58) Field of Classification Search
CPC ..... F24H 15/175; F24H 15/14; F24H 15/174; F24H 15/18; F24H 15/184; F24D 17/0073
See application file for complete search history.

(56) References Cited

U.S. PATENT DOCUMENTS 5,125,068 A * 6/1992 McNair ..... G05D 23/24 219/494
5,797,358 A * 8/1998 Brandt ..... F24H 9/2035 122/504
8,165,726 B2 4/2012 Nordberg et al.
8,813,687 B2 8/2014 Chaudhry et al.
10,132,510 B2 11/2018 Heil et al.
2008/0314999 A1* 12/2008 Strand ..... F24H 9/2035 236/20 R
2009/0120380 A1* 5/2009 Chian ..... F24H 9/2021 236/20 R

* cited by examiner

*Primary Examiner* — Steven S Anderson, II
(74) *Attorney, Agent, or Firm* — Dority & Manning, P.A.

(57) ABSTRACT

A water heater appliance may include a casing, a tank, a temperature sensor, a heating system, and a controller. The temperature sensor may be attached to the casing in thermal communication with the tank to detect a temperature thereof. The controller may be in operative communication with the heating system. The controller may be configured to initiate a heating cycle that includes receiving a setpoint request comprising a requested temperature value, detecting a first tank temperature value at the temperature sensor, generating a first modified temperature value less than the first tank temperature value, determining the requested temperature value is less than the first modified temperature value, setting a target setpoint to the first modified temperature value in response to determining the requested temperature value is less than the first modified temperature value, and directing the heating system according to the target setpoint.

20 Claims, 4 Drawing Sheets

WATER HEATER APPLIANCES AND METHODS FOR MITIGATING FALSE FAULT DETECTION

FIELD OF THE INVENTION

The present subject matter relates generally to water heater appliances, and more particularly to methods or water heater appliances having one or more features for mitigating or otherwise preventing false detection of a fault event.

BACKGROUND OF THE INVENTION

Water heater appliances (i.e., water heaters) are used for storing or supplying hot water to residential and commercial properties. A typical residential water heater holds about fifty gallons of water inside a steel reservoir tank. Heating assemblies (e.g., including one or more electric heating elements or gas burners) heat water within the tank during operation of such water heater appliances. Other residential water heaters are known as "constant flow" water heaters and include a relatively small tank or heat-exchange pipe in which water is heated as it flows through the water heater. Many water heaters permit a consumer to set the thermostat to a temperature between 90 and 150 degrees Fahrenheit (F) (32 to 65 degrees Celsius (C)). To prevent scalding and to save energy, consumers may set the thermostat to heat the reservoir water to a temperature in a range between 120 degrees F. to 140 degrees F. (about 49 degrees C. to 60 degrees C.).

Water heating may constitute a significant portion (e.g., 10 to 15%) of household energy usage. Thus, water heaters can be a significant drain on a local utility. Although most users or consumers do not typically alter the temperature setting for the thermostat (or tank generally) on a frequent basis, there are times when it may be desirable to change (e.g., increase or decrease) the temperature setting. Such occasions may arise, for instance, when a user plans to leave for an extended period of time (e.g., vacation) or otherwise wishes to reduce the energy consumption of the water heater.

Nonetheless, issues may arise, especially when significantly reducing the temperature setting. For instance, typical water heater appliances include one or more fault detection features to identify and curb heat output when the water temperature within at least a portion of the tank (e.g., the upper half) is significantly greater than the temperature setting. However, the reduction of water temperature does not immediately follow a change in the temperature setting. In turn, desired reductions in water temperature may inadvertently cause a fault condition to be falsely identified and addressed.

Accordingly, it would be useful to provide a water heater or method of operation that includes features steps or to mitigate or otherwise preventing a false fault condition from being identified (e.g., without undercutting the efficacy or efficiency of a fault-detection feature).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a water heater appliance is provided. The water heater appliance may include a casing, a tank, a temperature sensor, a heating system, and a controller. The tank may be disposed within the casing and define an inlet and an outlet. The temperature sensor may be attached to the casing in thermal communication with the tank to detect a temperature thereof. The heating system may be in thermal communication with the tank to heat water within the tank. The controller may be in operative communication with the heating system. The controller may be configured to initiate a heating cycle that includes receiving a setpoint request comprising a requested temperature value, detecting a first tank temperature value at the temperature sensor, generating a first modified temperature value less than the first tank temperature value, determining the requested temperature value is less than the first modified temperature value, setting a target setpoint to the first modified temperature value in response to determining the requested temperature value is less than the first modified temperature value, and directing the heating system according to the target setpoint.

In another exemplary aspect of the present disclosure, a method of operating a water heater appliance is provided. The method may include receiving a setpoint request comprising a requested temperature value. The method may further include detecting a first tank temperature value at a temperature sensor attached to a casing of the water heater appliance and generating a first modified temperature value less than the first tank temperature value. The method may still further include determining the requested temperature value is less than the first modified temperature value and setting a target setpoint to the first modified temperature value in response to determining the requested temperature value is less than the first modified temperature value. The method may yet further include directing a heating system according to the target setpoint.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
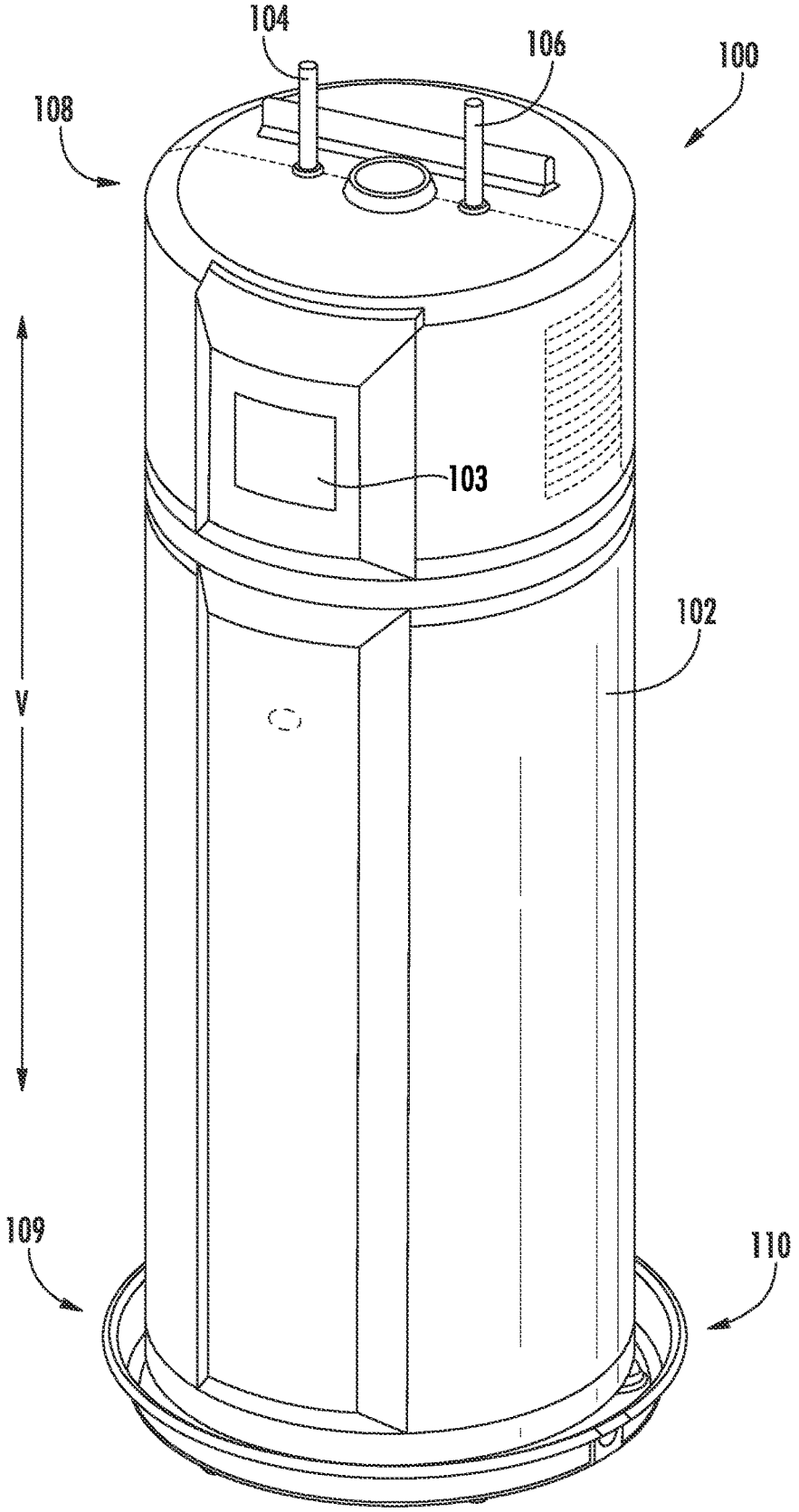
FIG. 1 provides a perspective view of a water heater appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
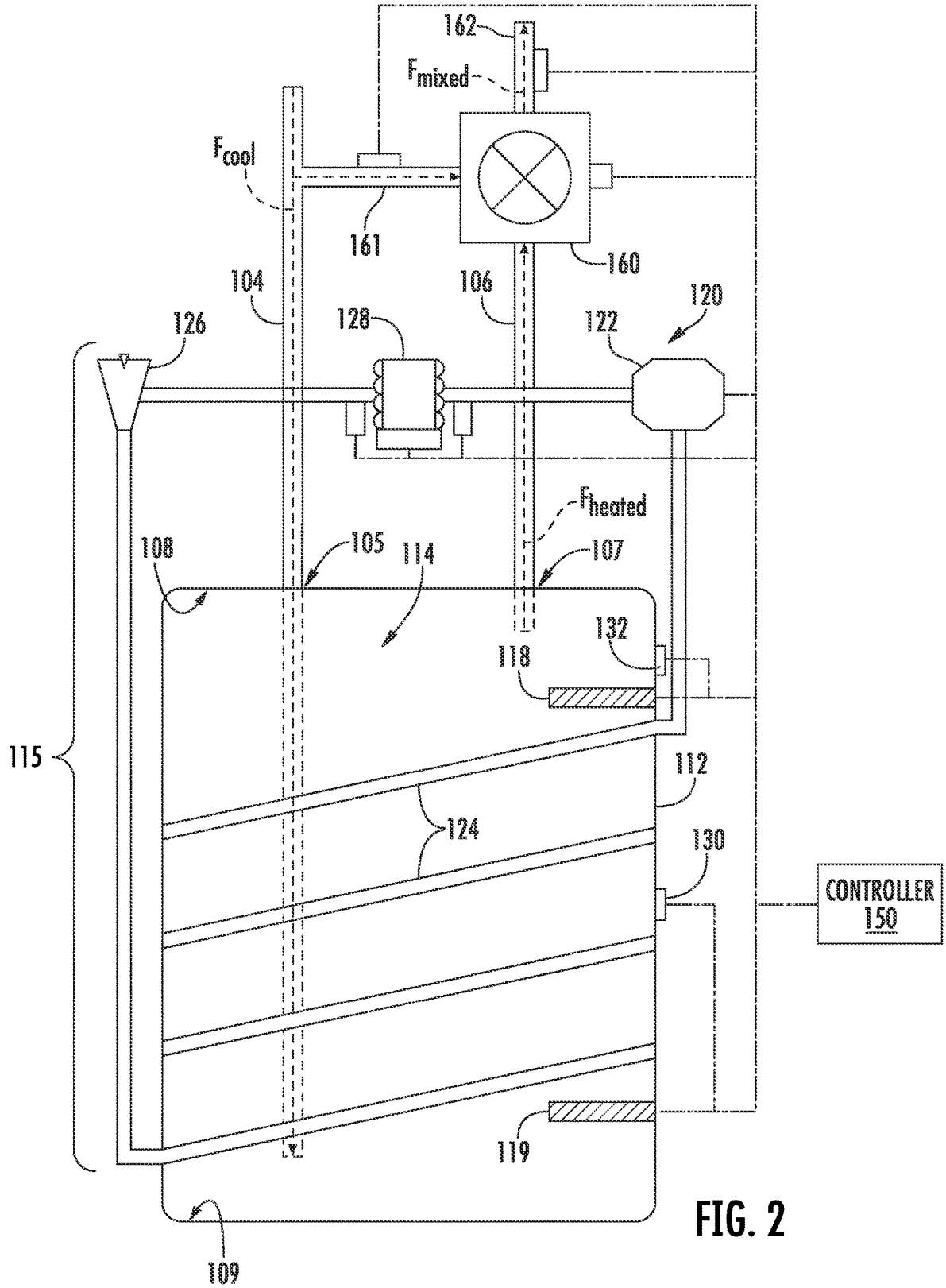
FIG. 2 provides a schematic view of certain components of the exemplary water heater appliance of FIG. 1.

Turning now to the figures, FIG. 1 provides a perspective view of a water heater appliance 100 according to an exemplary embodiment of the present subject disclosure. FIG. 2 provides a schematic view of certain components of water heater appliance 100. As may be seen in FIGS. 1 through 2, water heater appliance 100 includes a casing 102 and a tank 112 mounted within casing 102. Tank 112 defines an interior volume 114 for heating water therein.

Water heater appliance 100 also includes an inlet conduit 104 and an outlet conduit 106 that are both in fluid communication with tank 112 within casing 102. As an example, cold water from a water source, such as a municipal water supply or a well, enters water heater appliance 100 through inlet conduit 104 (e.g., at an inlet 105 extending through an upper portion of tank 112). From inlet conduit 104, such cold water enters interior volume 114 of tank 112 wherein the water is heated to generate heated water. Such heated water exits water heater appliance 100 at outlet conduit 106 (e.g., supplied through an outlet 107 at an upper portion of tank 112) and, for example, is supplied to a bath, shower, sink, or any other suitable feature.

As shown, interior volume 114 of tank 112 extends between a top portion 108 and a bottom portion 109 along a vertical direction V. Thus, water heater appliance 100 is generally vertically oriented. Water heater appliance 100 can be leveled (e.g., such that casing 102 is plumb in the vertical direction V) in order to facilitate proper operation of water heater appliance 100.

In certain embodiments, water heater appliance 100 includes a control panel 103 having one or more user inputs (e.g., attached to casing 102 proximal to top portion 108). Control panel 103 may be in communication with a controller 150 (FIG. 2), as would be understood. Control panel 103 may thus receive power as directed by controller 150. Additionally or alternatively, a user of water heater appliance 100 may interact with the user inputs of control panel 103 to operate the water heater appliance 100, and user commands may be transmitted between the user inputs and controller 150 to facilitate operation of the water heater appliance 100 based on such user commands. A display may additionally be provided in the control panel 103 in communication with the controller 150. The display may, for example be a touchscreen or other text-readable display screen, or alternatively may simply be a light that can be activated and deactivated as required to provide an indication of, for example, an event or setting for water heater appliance 100.

In certain embodiments, a drain pan 110 is positioned at bottom portion 109 of water heater appliance 100 such that water heater appliance 100 sits on drain pan 110. Drain pan 110 sits beneath water heater appliance 100 along the vertical direction V (e.g., to collect water that leaks from water heater appliance 100 or water that condenses on an evaporator 128 of water heater appliance 100). It should be understood that water heater appliance 100 is provided by way of example only and that the present subject matter may be used with any suitable water heater appliance.

It should be understood that water heater appliance 100 is provided by way of example only and that the present disclosure may be used with any suitable water heater appliance.

Turning now to FIG. 2, exemplary embodiments of water heater appliance 100 include a heating system 115, such as one or more of an upper heating element 118, a lower heating element 119, or a sealed system 120 in thermal communication with the tank 112. During operation of water heater appliance 100, one or all of upper heating element 118, lower heating element 119, or sealed system 120 may thus be selectively activated to heat water within interior volume 114 of tank 112.

As shown, the exemplary embodiments of FIG. 2 include upper heating element 118, lower heating element 119, or sealed system 120. Thus, the exemplary water heater appliance 100 is commonly referred to as a "heat pump water heater appliance." Upper and lower heating elements 118 and 119 can be any suitable heating elements. For example, upper heating element 118 or lower heating element 119 may be an electric resistance element, a microwave element, an induction element, or any other suitable heating element (including combinations thereof). Lower heating element 119 may also be a gas burner. Moreover, it is understood that illustrated heat pump water heater appliance embodiments is merely a non-limiting example, and other water heater appliance configurations may be provided within the scope of the present disclosure (e.g., embodiments including a different heating system having more heating elements, fewer heating elements, no sealed system, or a relatively-small tank in which water is heated as it flows therethrough).

Sealed system 120 includes a compressor 122, a condenser 124, a throttling device 126, and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor or high quality vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid or high quality liquid vapor mixture. This high quality/saturated liquid vapor mixture exits condenser 124 and travels through throttling device 126, which is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

A fan or air handler may assist with heat transfer between air about water heater appliance 100 (e.g., within casing 102) and refrigerant within evaporator 128. The air handler may be positioned within casing 102 on or adjacent evaporator 128. Thus, when activated, the air handler may direct a flow of air towards or across evaporator 128, and the flow of air from the air handler may assist with heating refrigerant within evaporator 128. It is understood that the air handler may be any suitable type of air handler, such as an axial or centrifugal fan.

As shown, water heater appliance 100 includes one or more tank temperature sensors, such as a first temperature sensor 130 (e.g., lower temperature sensor) and a second temperature sensor 132 (e.g., upper temperature sensor). Generally, tank temperature sensors 130, 132 are configured for measuring a temperature of water within interior volume 114 of tank 112 and can be any suitable temperature sensing device (e.g., in operative communication with the controller 150). For example, one or more tank temperature sensors 130, 132 may be provided as a thermocouple, thermistor, or electromechanical temperature-dependent switch (e.g., bimetal switch).

Tank temperature sensors 130, 132 may be positioned at any suitable location within or on water heater appliance 100. For instance, one or more tank temperature sensors 130, 132 may be positioned within interior volume 114 of tank 112 or may be mounted to tank 112 outside of interior volume 114 of tank 112. When mounted to tank 112 outside of interior volume 114 of tank 112, a tank temperature sensor (e.g., first temperature sensor 130 or second temperature sensor 132) can be configured for indirectly measuring the temperature of water within interior volume 114 of tank 112. For example, tank temperature sensors 130, 132 can measure the temperature of tank 112 and correlate the temperature of tank 112 to the temperature of water within interior volume 114 of tank 112. Additionally or alternatively, one or more tank temperature sensor 130 or 132 may also be positioned at or adjacent top portion 108 of water heater appliance 100 (e.g., at or adjacent an inlet of outlet conduit 106).

In certain embodiments, first temperature sensor 130 is attached to tank 112 at a location below second temperature sensor 132. For instance, first temperature sensor 130 may be mounted above lower heating element 119, but below upper heating element 118. Additionally or alternatively, second temperature sensor 132 may be mounted above upper heating element 118. One or both of temperature sensors 130, 132 may be mounted above a midpoint of tank 112 (e.g., at upper half of tank 112).

Water heater appliance 100 further includes a power source or controller 150 that is configured for regulating operation of water heater appliance 100 (e.g., by selectively directing electrical power energy from a connected power grid). Controller 150 is in, for example, operative communication (e.g., electrical communication through one or more conductive wires/busses) with upper heating element 118, lower heating element 119, compressor 122, or tank temperature sensors 130, 132. Thus, controller 150 may selectively activate the heating system (e.g., upper heating element 118, lower heating element 119, or compressor 122) in order to heat water within interior volume 114 of tank 112. As an example, controller 150 may activate/deactivate heating elements 118, 119 based on or in response to signals from temperature sensors 130, 132. Moreover, controller 150 may initiate one or more heating cycles or methods (e.g., method 300—FIG. 3) to control operations of water heater appliance 100.

In some embodiments, controller 150 includes memory (e.g., non-transitive media) and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 150 may generally operate upper heating element 118, lower heating element 119, or compressor 122 in order to heat water within interior volume 114 of tank 112 (e.g., as part of a heating cycle). As an example, in certain modes of operation, a user may select or establish a requested temperature value for a target setpoint, $t_s$, for water within interior volume 114 of tank 112 (e.g., via a setpoint request prompted from a control panel or user interface of the appliance 100). Additionally or alternatively, the target setpoint $t_s$ for water within interior volume 114 of tank 112 may be set (e.g., initially) to a default value. Further additionally or alternatively, the target setpoint $t_s$ may be variably set as one or more modified temperature values (e.g., as described below).

Based upon the target setpoint $t_s$ for water within interior volume 114 of tank 112, controller 150 may selectively activate upper heating element 118, lower heating element 119, or compressor 122. For instance, a temperature range may be provided for the target setpoint $t_s$ (e.g., as it exists or is set at a given contemporaneous moment). In other words, a range (e.g., fixed or variable temperature range) may be provided that establishes a target minimum $t_{smin}$ and a target maximum $t_{smin}$ based on the target setpoint $t_s$. As would be understood, the target minimum $t_{smin}$ and the target maximum $t_{smin}$ are below and above, respectively, the target setpoint $t_s$. If the water within interior volume 114 of tank 112 falls below the target minimum $t_{smin}$, upper heating element 118, lower heating element 119, or compressor 122 may be activated to heat the water. If the water within interior volume 114 of tank 112 rises above the target maximum $t_{smax}$, upper heating element 118, lower heating element 119, or compressor 122 may be deactivated to stop heating the water.

The target setpoint $t_s$ for water within interior volume 114 of tank 112 may be any suitable temperature. For example, the target setpoint $t_s$ for water within interior volume 114 of tank 112 may be a value between 50 and 160 degrees Fahrenheit (F) (10 to 71 degrees Celsius (C)). To prevent scalding and to save energy, consumers may set the thermostat to heat the reservoir water to a temperature in a range between 100 degrees F. to 140 degrees F. (about 38 degrees C. to 60 degrees C.).

As would be understood, controller 150 (or appliance 100, generally) may include fault detection features to identify and curb heat output from the heating system 115 (e.g., heating element 118, heating element 119, or sealed system 120) in response to detecting a water temperature that is above the target setpoint $t_s$ (e.g., by a fault offset that is at least a predetermined temperature value or percentage). For instance, the fault detection features may identify a fault condition in response to detecting a water temperature that is at least 8 degrees F. (about 4 degrees C.) greater than the contemporaneous target setpoint $t_s$. Generally, such features may issue a fault notification (e.g., at the control panel 103) in response to identifying a fault condition. Optionally, such features may halt or otherwise restrict heat output from the heating system 115 in response to identifying a fault condition.

In optional embodiments water heater appliance 100 includes a mixing valve 160 and a mixed water outlet conduit 162. Mixing valve 160 may be in fluid communication with inlet conduit 104 via a bypass conduit 161, tank 112, and mixed water outlet conduit 162. As would be understood, mixing valve 160 may be configured for selectively directing water from inlet conduit 104 and tank 112 into mixed water outlet conduit 162 in order to regulate a temperature of water within mixed water outlet conduit 162. Mixing valve 160 may be positioned or disposed within casing 102 of water heater appliance 100 (e.g., such that mixing valve 160 is integrated within water heater appliance 100).

Figure 3:
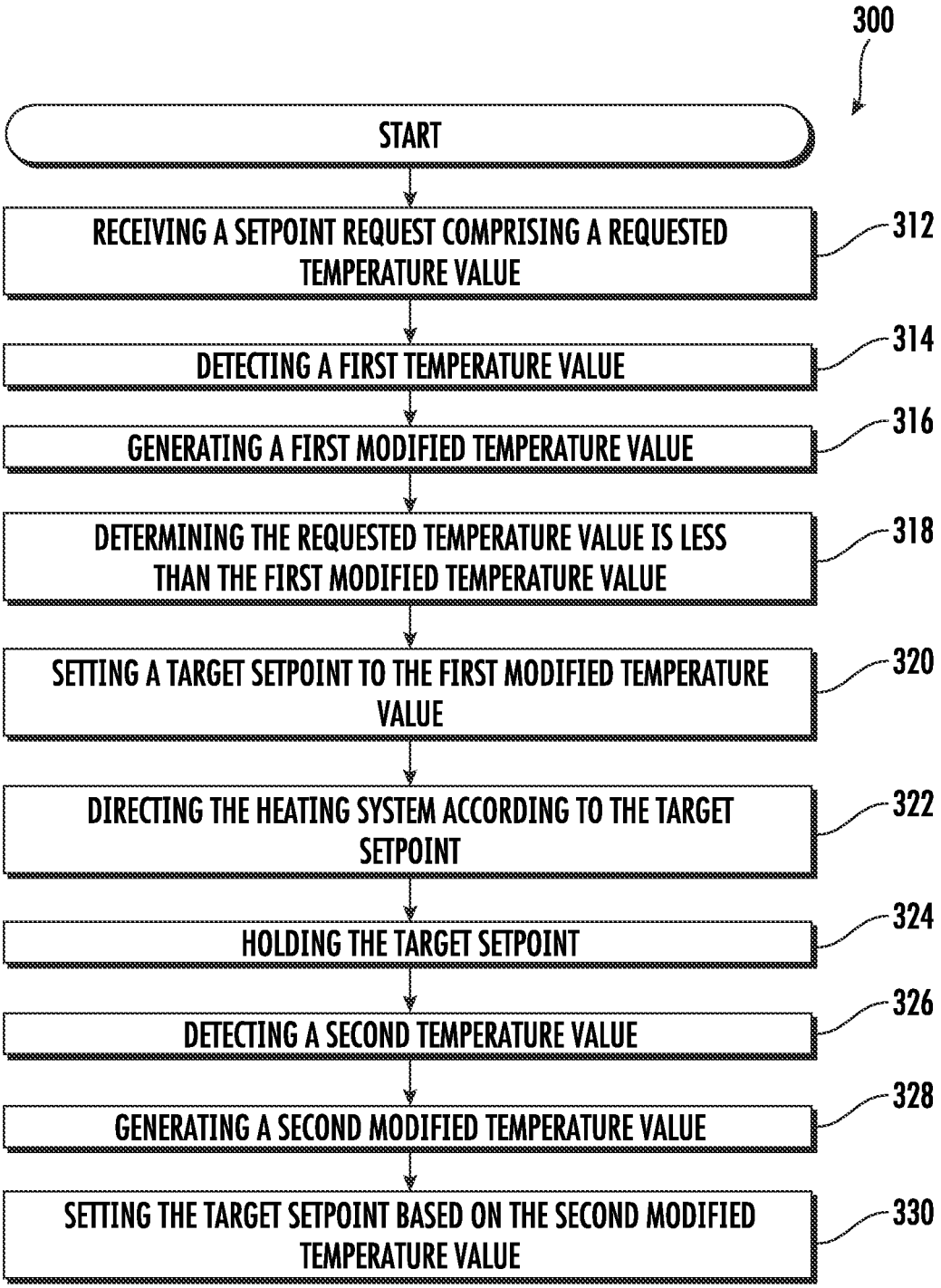
FIG. 3 provides a flow chart illustrating a method of operating a water heater appliance according to exemplary embodiments of the present disclosure.
Figure 4:
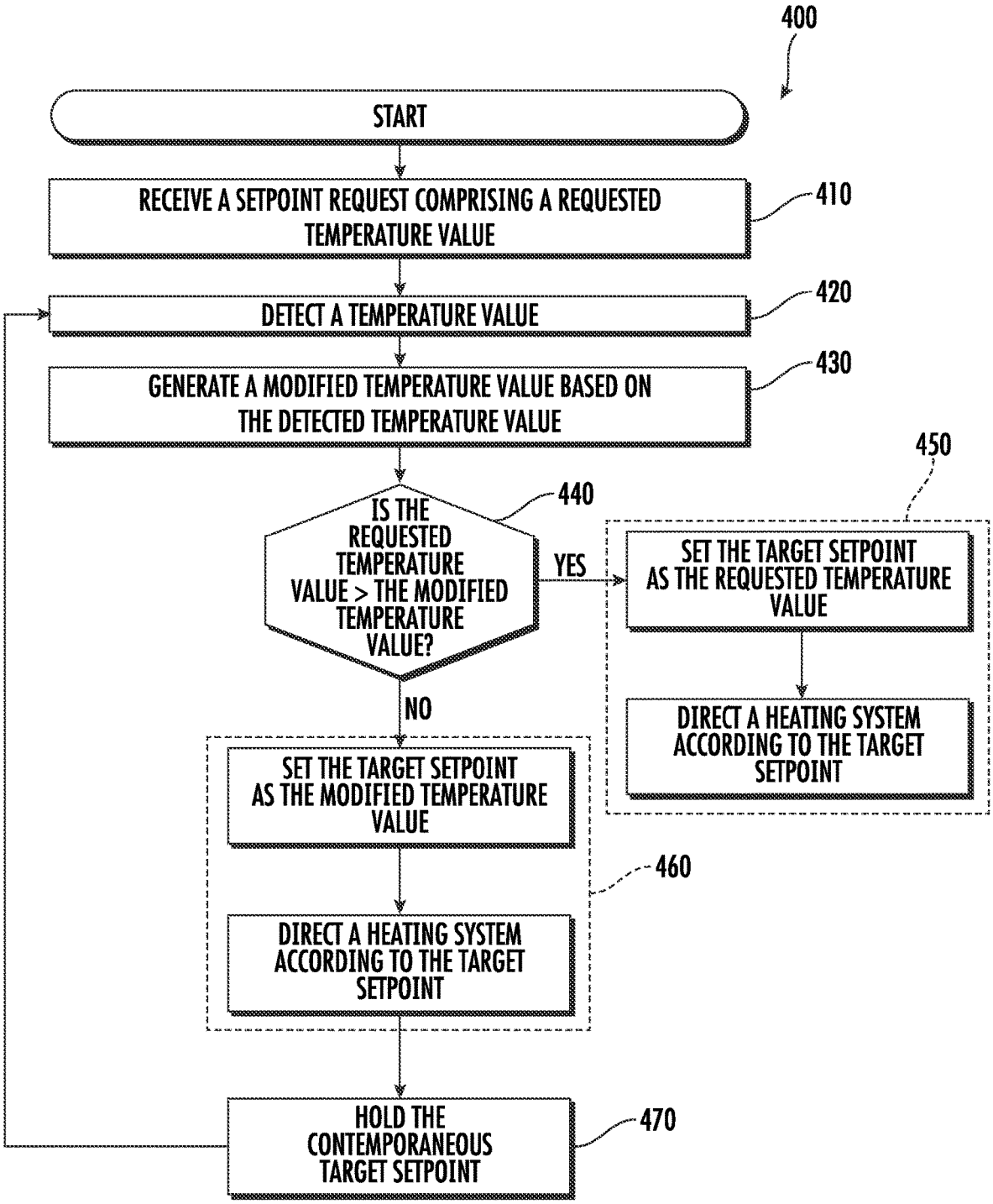
FIG. 4 provides a flow chart illustrating a method of operating a water heater appliance according to exemplary embodiments of the present disclosure.

Turning now to FIGS. 3 and 4, flow diagrams are provided of methods 300 and 400 according to an exemplary embodiments of the present disclosure. Generally, the methods 300 and 400 provide for controlling and operating a water heater appliance, such as water heater appliance 100 (FIGS. 1 and 2) (e.g., according to a heating cycle). For instance, methods 300 and 400 may provide for directing operations at one or more of control panel 103, upper heating element 118, lower heating element 119, compressor 122, mixing valve 160, as well as any other features of a suitable water appliance. The methods 300 and 400 may be performed, for instance, by the controller 150. As described above, the controller 150 may be in operative communication with control panel 103, upper heating element 118, lower heating element 119, compressor 122, mixing valve 160, or temperature sensor(s) 130, 132. Controller 150 may send signals to and receive signals from one or more of control panel 103, upper heating element 118, lower heating element 119, compressor 122, mixing valve 160, or temperature sensor(s) 130, 132. Controller 150 may further be in communication with other suitable components of the appliance 100 to facilitate operation of the water heater appliance 100 generally.

FIGS. 3 and 4 depict steps performed in a particular order for purpose of illustration and discussion. Those of ordinary skill in the art, using the disclosures provided herein, will understand that (except as otherwise indicated) methods 300 and 400 are not mutually exclusive. Moreover, the steps of the methods 300 and 400 can be modified, adapted, rearranged, omitted, interchanged, or expanded in various ways without deviating from the scope of the present disclosure.

Advantageously, methods in accordance with the present disclosure may mitigate or otherwise preventing a false fault condition from being identified (e.g., without undercutting the efficacy or efficiency of one or more fault-detection features).

Turning especially to FIG. 3, at 312, the method 300 includes receiving a setpoint request comprising a requested temperature value. For instance, a user may enter the requested temperature value at the control panel, or at another suitable input interface for the appliance. In response to such an entered request, the setpoint request may be transmitted to the controller of the appliance to indicate the temperature at which the user wants the water tank to eventually reach and remain.

At 314, the method 300 includes detecting a first tank temperature value at the temperature sensor (e.g., first temperature sensor or second temperature sensor). As is understood, the temperature sensor may transmit one or more temperature signals to the controller that correspond to water temperature within the tank. From the temperature signal(s), the first tank temperature value may thus be detected as the temperature for water within the water tank. Such a detection may occur following 312 (e.g., in response to the same) or, alternatively, prior to 312 (e.g., within at least a predetermined window of time before 312).

At 316, the method 300 includes generating a first modified temperature value in response to 312 or 314. In general, the first modified temperature value is less than the first tank temperature value and may be based on the same. For instance, the first modified temperature value may be generated, at least in part, by reducing the first tank temperature value by a predetermined offset. In other words, the predetermined offset (i.e., a value that has been predetermined for offsetting the first tank temperature value) may be subtracted from the first tank temperature value. In some embodiments, the predetermined offset is a fixed value (e.g., in degrees).

For instance, the predetermined offset may be provided as a value that is greater than or equal to 3 degrees F. (1.7 degrees C.), 5 degrees F. (2.8 degrees C.), or 10 degrees F. (5.5 degrees C.). Optionally, the predetermined offset may be less than a fault offset (e.g., programmed within the controller), which may otherwise trigger a fault detection.

At 318, the method 300 includes determining the requested temperature value is less than the first modified temperature value. Thus, the requested temperature value may be compared to the first modified temperature value. Moreover, that comparison may determine or otherwise indicate the requested temperature value is less than the first modified temperature value.

At 320, the method 300 includes setting a target setpoint for the water tank to the first modified temperature value. In some embodiments, 320 is in response to 318. Thus, 318 may cause the target setpoint to be changed from its previous or contemporaneous value (e.g., at the time of 318) to the first modified temperature value. As would be understood, the previous or contemporaneous value may be a value previously requested by the user or set by default (i.e., a default temperature value). In most cases, the previous or contemporaneous value for the target setpoint will be greater than the requested temperature value.

At 322, the method 300 includes directing the heating system according to the target setpoint. In other words, the heating system may selectively activate/deactivate or otherwise heat the water within the water tank until the target setpoint is reached, as would be understood. Once the target setpoint is set in 320, the water tank may require cooling. Thus, in response to 320, the heating system may be deactivated or otherwise restricted from generating heat (e.g., until the target setpoint is met or one or more set temperature minimums are achieved). Subsequently, the heating system may be activated or otherwise directed to generate heat (e.g., until the target setpoint is met or one or more set temperature maximums are achieved).

At 324, the method 300 includes optionally holding the target setpoint at the first modified temperature value. Thus, the heating system may be directed to bring or maintain the water tank to/at the target setpoint (e.g., between the maximum and minimums) for the duration of 324. Optionally, a predetermined time period may be provided. For instance, the predetermined time period may be provided as a hold time greater than or equal to 30 seconds, 1 minute, 2 minutes, 5 minutes, or 10 minutes. At the expiration of the predetermined time, the method 300 may proceed to 326.

At 326, the method 300 includes detecting a second tank temperature value following 320 (e.g., and, optionally, 324). The second tank temperature value may be detected at, for instance, first temperature sensor or second temperature sensor. Specifically, the second tank temperature value may be detected at the same temperature sensor or location as 314 (e.g., at a different, later time). As is understood, the temperature sensor may transmit one or more temperature signals to the controller that correspond to water temperature within the tank. From the temperature signal(s), the second tank temperature value may thus be detected as the temperature for water within the water tank.

At 328, the method 300 includes generating a second modified temperature value in response to 326. The second modified temperature value is less than the second tank temperature value and may be based on the same. For instance, the second modified temperature value may be generated, at least in part, by reducing the second tank temperature value by a predetermined offset. In other words, the predetermined offset (i.e., a value that has been predetermined for offsetting the second tank temperature value) may be subtracted from the second tank temperature value. In some embodiments, the predetermined offset for the second tank temperature value is the same predetermined offset as 316.

Once generated, the second modified temperature value may be compared to the requested temperature value. Thus, it may be determined if either the requested temperature value is less than the second modified temperature value or, alternatively, that the requested temperature value is greater than or equal to the second modified temperature value.

At 330, the method 300 includes setting the target setpoint based on the second modified temperature value. For instance, the target setpoint may be set according to the comparison between the second modified temperature value and the requested value. If the requested temperature value is less than the second modified temperature value (e.g., in response to the same), 330 may include setting the target setpoint to the second modified temperature value. By contrast, if the requested temperature value is greater than or equal to the second modified temperature value (e.g., in response to the same), 330 may include setting the target setpoint to the requested temperature value. Subsequently, the heating system may continue to operate or be directed according to the target setpoint (e.g., and thus according to the second modified temperature value or the requested temperature value of 330).

It is noted that under certain conditions a user may request a temperature that is greater than a detected temperature at the temperature sensor (i.e., specify an elevated temperature value). In such conditions (e.g., in response to the same), the method 300 may provide for setting the setpoint target (e.g., immediately or directly) to the elevated temperature value. In turn, the heating system may be directed to heat the water tank accordingly. In other words, the method 300 may include receiving a setpoint increase request that includes a requested elevated temperature value greater than a second contemporaneous value of the target setpoint, and setting the target setpoint as the requested elevated temperature value in response to receiving the setpoint increase request. Subsequently, the heating system may continue to operate or be directed according to the target setpoint (e.g., and thus according to the requested elevated temperature value).

Turning especially to FIG. 4, at 410, the method 400 includes receiving a setpoint request comprising a requested temperature value. For instance, a user may enter the requested temperature value at the control panel, or at another suitable input interface. In response to such an entered request, the setpoint request may be transmitted to the controller of the appliance to indicate the temperature at which the user wants the water tank to eventually reach and remain.

At 420, the method 400 includes detecting a temperature value at a temperature sensor (e.g., the first temperature sensor or the second temperature sensor). As is understood, the temperature sensor may transmit one or more temperature signals to the controller that correspond to water temperature within the tank. From the temperature signal(s), the temperature value may thus be detected as the temperature for water within the water tank. Such a detection may occur following 410 (e.g., in response to the same) or, alternatively, prior to 410 (e.g., within at least a predetermined window of time before 410).

At 430, the method 400 includes generating a modified temperature value based on the detected tank temperature value (e.g., in response to 410 or 420). The modified temperature value is less than the detected tank temperature value and may be based on the same. For instance, the modified temperature value may be generated, at least in part, by reducing the detected tank temperature value by a predetermined offset. In other words, the predetermined offset (i.e., a value that has been predetermined for offsetting the detected tank temperature value) may be subtracted from the detected tank temperature value. In some embodiments, the predetermined offset is a fixed value (e.g., in degrees). For instance, the predetermined offset may be provided as a value that is greater than or equal to 3 degrees F. (1.7 degrees C.), 5 degrees F. (2.8 degrees C.), or 10 degrees F. (5.5 degrees C.). Optionally, the predetermined offset may be less than a fault offset (e.g., programmed within the controller).

At 440, the method 400 include evaluating the requested temperature value in light of the modified temperature value. Specifically, the requested temperature value may be compared to the modified temperature value. If the requested temperature value is greater than the modified temperature value, the method 400 may proceed to 450. If the requested temperature value is less than or equal to the modified temperature value, the method 400 may proceed to 460.

At 450, the method 400 includes adopting the requested temperature value. For instance, in response to determining the requested temperature value is greater than the modified temperature value, the target setpoint may be set as the requested temperature value. As would be understood, the previous or contemporaneous value may be a value previously requested by the user or set by default (i.e., a default temperature value). Thus, the previous value may be changed to the requested temperature value. In turn, the heating system may be directed according to the requested temperature value. In other words, the heating system may selectively activate or otherwise heat the water within the water tank until the requested temperature value is met, as would be understood. Once the requested temperature value is met, the appliance may generally maintain this as the target setpoint (e.g., until a new request is received), as is also understood.

At 460, the method 400 includes adopting the modified temperature value. For instance, in response to determining the requested temperature value is less than or equal to the modified temperature value, the target setpoint may be set as the modified temperature value. As would be understood, the previous or contemporaneous value may be a value previously requested by the user or set by default (i.e., a default temperature value). Thus, the previous value may be changed to the modified temperature value. In turn, the heating system may be directed according to the modified temperature value. In other words, the heating system may be deactivated or otherwise restricted from generating heat (e.g., until the modified temperature value or one or more set temperature minimums are achieved). Subsequently, the heating system may be activated or otherwise directed to generate heat (e.g., until the target setpoint is met or one or more set temperature maximums are achieved).

At 470, the method 400 comprises holding the contemporaneous target setpoint. In other words, the modified temperature value from 460 may be held as the target setpoint as the heating system continues to heat the tank according to the target setpoint (i.e., the modified temperature value at this moment). Thus, the heating system may be directed to bring or maintain the water tank at the target setpoint (e.g., between the maximum and minimums) for the duration of 470. Optionally, a predetermined time period may be provided. For instance, the predetermined time period may be provided as a hold time greater than or equal to 30 seconds, 1 minute, 2 minutes, 5 minutes, or 10 minutes. At the expiration of the predetermined time, the method 400 may return to 420.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance comprising:

a casing;

a tank disposed within the casing, the tank defining an inlet and an outlet;

a temperature sensor attached to the casing in thermal communication with the tank to detect a temperature thereof;

a heating system in thermal communication with the tank to heat water within the tank; and a controller in operative communication with the heating system, the controller being configured to initiate a heating cycle, the heating cycle comprising receiving a setpoint request comprising a requested temperature value, detecting a first tank temperature value at the temperature sensor, generating a first modified temperature value less than the first tank temperature value, determining the requested temperature value is less than the first modified temperature value, setting a target setpoint to the first modified temperature value in response to determining the requested temperature value is less than the first modified temperature value, and directing the heating system according to the target setpoint.

2. The water heater appliance of claim 1, wherein generating the first modified temperature value comprises reducing the first tank temperature value by a predetermined offset.

3. The water heater appliance of claim 2, wherein the predetermined offset is a fixed value.

4. The water heater appliance of claim 1, wherein the heating cycle further comprises detecting a second tank temperature value at the temperature sensor following setting the target setpoint to the first modified temperature value, generating a second modified temperature value less than the second tank temperature value, and setting the target setpoint based on the second modified temperature value.

5. The water heater appliance of claim 4, wherein the heating cycle further comprises holding the target setpoint at the first modified temperature value for a predetermined time period prior to detecting the second tank temperature value.

6. The water heater appliance of claim 4, wherein the heating cycle further comprises determining the requested temperature value is less than the second modified temperature value, and wherein setting the target setpoint based on the second modified temperature value comprises setting the target setpoint to the second modified temperature value in response to determining the requested temperature value is less than the second modified temperature value.

7. The water heater appliance of claim 4, wherein the heating cycle further comprises determining the requested temperature value is greater than or equal to the second modified temperature value, and wherein setting the target setpoint based on the second modified temperature value comprises setting the target setpoint to the requested temperature value in response to determining the requested temperature value is greater than or equal to the second modified temperature value.

8. The water heater appliance of claim 4, wherein generating the first modified temperature value comprises reducing the first tank temperature value by a predetermined offset, and wherein generating the second modified temperature value comprises reducing the second tank temperature value by the predetermined offset.

9. The water heater appliance of claim 1, wherein the received setpoint request is a setpoint decrease request, wherein the requested temperature value is a requested decrease value less than a first contemporaneous value of the target setpoint, and wherein the heating cycle further comprises receiving a setpoint increase request comprising a requested elevated temperature value greater than a second contemporaneous value of the target setpoint, and setting the target setpoint as the requested elevated temperature value in response to receiving the setpoint increase request.

10. A method of operating a water heater appliance, the method comprising:

receiving a setpoint request comprising a requested temperature value, detecting a first tank temperature value at a temperature sensor attached to a casing of the water heater appliance;

generating a first modified temperature value less than the first tank temperature value;

determining the requested temperature value is less than the first modified temperature value;

setting a target setpoint to the first modified temperature value in response to determining the requested temperature value is less than the first modified temperature value; and directing a heating system according to the target setpoint.

11. The method of claim 10, wherein generating the first modified temperature value comprises reducing the first tank temperature value by a predetermined offset.

12. The method of claim 11, wherein the predetermined offset is a fixed value.

13. The method of claim 10, further comprising:

detecting a second tank temperature value at the temperature sensor following setting the target setpoint to the first modified temperature value;

generating a second modified temperature value less than the second tank temperature value; and setting the target setpoint based on the second modified temperature value.

14. The method of claim 13, further comprising:

holding the target setpoint at the first modified temperature value for a predetermined time period prior to detecting the second tank temperature value.

15. The method of claim 14, further comprising:

determining the requested temperature value is less than the second modified temperature value, and wherein setting the target setpoint based on the second modified temperature value comprises setting the target setpoint to the second modified temperature value in response to determining the requested temperature value is less than the second modified temperature value.

16. The method of claim 14, further comprising:

determining the requested temperature value is greater than or equal to the second modified temperature value, and wherein setting the target setpoint based on the second modified temperature value comprises setting the target setpoint to the requested temperature value in response to determining the requested temperature value is greater than or equal to the second modified temperature value.

17. The method of claim 14, wherein generating the first modified temperature value comprises reducing the first tank temperature value by a predetermined offset, and wherein generating the second modified temperature value comprises reducing the second tank temperature value by the predetermined offset.

18. The method of claim 10, wherein the received setpoint request is a setpoint decrease request, wherein the requested temperature value is a requested decrease value less than a first contemporaneous value of the target setpoint, and wherein the method further comprises:

receiving a setpoint increase request comprising a requested elevated temperature value greater than a second contemporaneous value of the target setpoint, and setting the target setpoint as the requested elevated temperature value in response to receiving the setpoint increase request.

19. A method of operating a water heater appliance, the method comprising:

receiving a setpoint request comprising a requested temperature value, detecting a first tank temperature value at a temperature sensor attached to a casing of the water heater appliance;

generating a first modified temperature value less than the first tank temperature value;

determining the requested temperature value is less than the first modified temperature value;

setting a target setpoint to the first modified temperature value in response to determining the requested temperature value is less than the first modified temperature value;

directing a heating system according to the target setpoint;

holding the target setpoint at the first modified temperature value for a predetermined time period following setting the target setpoint to the first modified temperature value;

detecting a second tank temperature value at the temperature sensor following the predetermined time period;

generating a second modified temperature value less than the second tank temperature value; and setting the target setpoint based on the second modified temperature value, wherein generating the first modified temperature value comprises reducing the first tank temperature value by a predetermined offset, and wherein generating the second modified temperature value comprises reducing the second tank temperature value by the predetermined offset.

20. The method of claim 19, further comprising:

determining the requested temperature value is less than the second modified temperature value, and wherein setting the target setpoint based on the second modified temperature value comprises setting the target setpoint to the second modified temperature value in response to determining the requested temperature value is less than the second modified temperature value.

* * * * *